US009482994B2

(12) United States Patent
Tanaka

(10) Patent No.: US 9,482,994 B2
(45) Date of Patent: Nov. 1, 2016

(54) IMAGE FORMING APPARATUS

(71) Applicant: Shinya Tanaka, Kanagawa (JP)

(72) Inventor: Shinya Tanaka, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/881,293

(22) Filed: Oct. 13, 2015

(65) Prior Publication Data

US 2016/0109831 A1 Apr. 21, 2016

(30) Foreign Application Priority Data

Oct. 15, 2014 (JP) ..... 2014-210621

(51) Int. Cl.
*G03G 15/16* (2006.01)

(52) U.S. Cl.
CPC ..... *G03G 15/1665* (2013.01)

(58) Field of Classification Search
None
See application file for complete search history.

(56) References Cited

U.S. PATENT DOCUMENTS

| | | | |
|---|---|---|---|
| 8,712,267 | B2 | 4/2014 | Sugimoto et al. |
| 8,787,806 | B2 | 7/2014 | Nakamura et al. |
| 8,818,221 | B2 | 8/2014 | Ogino et al. |
| 8,929,760 | B2 | 1/2015 | Tanaka et al. |
| 8,929,786 | B2 | 1/2015 | Takeuchi et al. |
| 8,934,822 | B2 | 1/2015 | Mimbu et al. |
| 8,965,227 | B2 | 2/2015 | Mizutani et al. |
| 8,977,153 | B2 | 3/2015 | Ogiyama et al. |
| 8,983,322 | B2 | 3/2015 | Sugimoto et al. |
| 9,020,382 | B2 | 4/2015 | Aoki et al. |
| 9,031,480 | B2 | 5/2015 | Suzuki et al. |
| 9,046,830 | B2 | 6/2015 | Tanaka et al. |
| 9,075,350 | B2 | 7/2015 | Tanaka et al. |
| 9,081,335 | B2 | 7/2015 | Sugimoto et al. |
| 9,122,207 | B2 | 9/2015 | Nakamura et al. |
| 9,134,656 | B2 | 9/2015 | Mizutani et al. |
| 2010/0303518 | A1* | 12/2010 | Aimoto ..... G03G 15/1675 399/314 |
| 2012/0237234 | A1* | 9/2012 | Sugimoto ..... G03G 15/1675 399/50 |

(Continued)

FOREIGN PATENT DOCUMENTS

| | | | |
|---|---|---|---|
| JP | 08202110 A | * | 8/1996 |
| JP | 2006-267486 | | 10/2006 |

(Continued)

OTHER PUBLICATIONS

JP 08202110 English translation, Andou et al., Aug. 1996.*

(Continued)

*Primary Examiner* — David Gray
*Assistant Examiner* — Thomas Giampaolo, II
(74) *Attorney, Agent, or Firm* — Oblon, McClelland, Maier & Neustadt, L.L.P.

(57) ABSTRACT

An image forming apparatus includes an image bearer to bear a toner image on a surface thereof, a transfer device to contact the image bearer to form a transfer nip, and a power source to output a voltage to transfer the toner image from the image bearer onto a recording medium interposed at the transfer nip. The voltage including a first voltage in a transfer direction in which the toner image is transferred from the image bearer to the recording medium and a second voltage having a polarity opposite that of the first voltage. The first voltage and the second voltage alternate upon transfer of the toner image from the image bearer to the recording medium. The power source is configured to output the voltage that is superimposed a plurality of the alternating current voltage having a basic waveform, and a waveform of the voltage is biased in the transferring direction.

16 Claims, 8 Drawing Sheets

(56) References Cited

U.S. PATENT DOCUMENTS

| | | | | |
|---|---|---|---|---|
| 2013/0136468 | A1 | 5/2013 | Shimizu et al. | |
| 2013/0136477 | A1* | 5/2013 | Ogiyama | G03G 15/18 399/66 |
| 2013/0177329 | A1 | 7/2013 | Tanaka et al. | |
| 2013/0195483 | A1 | 8/2013 | Shimizu et al. | |
| 2013/0308968 | A1 | 11/2013 | Tanaka et al. | |
| 2014/0029988 | A1 | 1/2014 | Shimizu et al. | |
| 2014/0314435 | A1 | 10/2014 | Kato et al. | |
| 2014/0328604 | A1 | 11/2014 | Tanaka et al. | |
| 2015/0212453 | A1 | 7/2015 | Tanaka et al. | |

FOREIGN PATENT DOCUMENTS

| | | |
|---|---|---|
| JP | 2012-063746 | 3/2012 |
| JP | 2013-127592 | 6/2013 |

OTHER PUBLICATIONS

U.S. Appl. No. 14/005,770, filed Mar. 16, 2015.

* cited by examiner

IMAGE FORMING APPARATUS

CROSS-REFERENCE TO RELATED APPLICATIONS

This patent application is based on and claims priority pursuant to 35 U.S.C. §119(a) to Japanese Patent Application No. 2014-210621, filed on Oct. 15, 2014 in the Japan Patent Office, the entire disclosure of which is incorporated by reference.

BACKGROUND

1. Technical Field

The present invention relates to an image forming apparatus for transferring a toner image formed on the surface of an image carrier onto a recording medium at a transfer nip. The image forming apparatus may be implemented, for example, as a copier, a printer, a facsimile machine, or a multifunction peripheral having at least two of copying, printing, facsimile transmission, plotting, and scanning capabilities.

2. Description of the Related Art

An image forming apparatus forms a toner image on the surface of a drum-shaped photosensitive element functioning as an image carrier through a known electrophotographic process. An endless intermediate transfer belt that is an image carrier as an intermediate transfer body abuts against the photosensitive element, and a primary transfer nip is thus formed. The toner image formed on the photosensitive element is then primarily transferred onto the intermediate transfer belt at the primary transfer nip.

A secondary transfer roller as a transfer member abuts against the intermediate transfer belt, and a secondary transfer nip is thus formed. A secondary transfer facing roller is arranged inside of the loop of the intermediate transfer belt, and the intermediate transfer belt is nipped between the secondary transfer facing roller and the secondary transfer roller. The secondary transfer facing roller arranged inside of the loop is grounded. A secondary transfer bias (voltage) is applied from a power supply to the secondary transfer roller arranged outside of the loop. In this manner, a secondary transfer field for electrostatically transferring the toner image from the secondary transfer facing roller to the secondary transfer roller is formed between the secondary transfer facing roller and the secondary transfer roller, that is, in the secondary transfer nip.

The toner image on the intermediate transfer belt is then secondarily transferred onto a recording sheet fed into the secondary transfer nip at operational timing synchronized with the toner image on the intermediate transfer belt, by the effects of the secondary transfer field and a nipping pressure.

In such a structure, when a recording sheet with a highly textured surface such as washi (Japanese paper) is used, density patterns following the texture of the surface could be more easily formed in an image. These density patterns are caused because a sufficient amount of toner is not transferred onto recessed parts of the paper surface, and the image density in the recessed parts becomes thin compared with that in projected parts.

An object of the present invention is to provide an image forming apparatus for suppressing formations of white spots and achieving high quality images, while obtaining sufficient image densities in both of the recessed parts and the projected parts of a recording medium surface.

SUMMARY

In view of the foregoing, in an aspect of this disclosure, there is provided an image forming apparatus including an image bearer, a transfer device, and a power source. The image bearer bears a toner image on a surface thereof. The transfer device contacts the image bearer to form a transfer nip. The power source outputs a voltage to transfer the toner image from the image bearer onto a recording medium interposed at the transfer nip. The voltage includes a first voltage in a transfer direction in which the toner image is transferred from the image bearer to the recording medium and a second voltage having a polarity opposite that of the first voltage, and the first voltage and the second voltage alternate to transfer the toner image from the image bearer to the recording medium. The power source outputs the voltage that is superimposed a plurality of the alternating current voltage having a basic waveform, and a waveform of the voltage is biased on the transferring direction.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
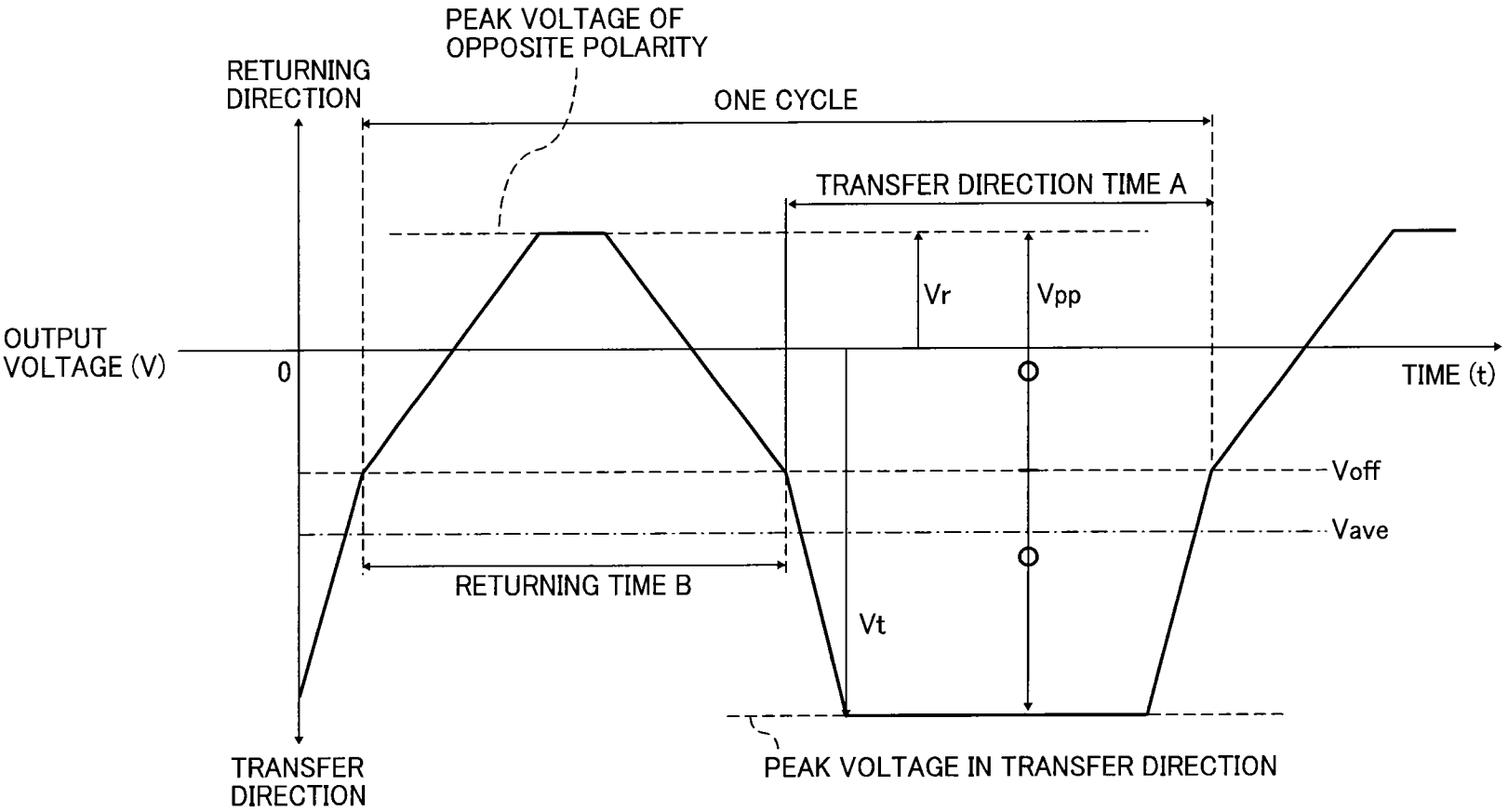
FIG. 1 is a waveform chart showing an example of a waveform of a secondary transfer bias.

Various embodiments of the present invention will be described below with reference to the accompanying drawings. In the descriptions of the embodiments, the same components or components with the same functions are denoted by the same reference symbols, and the same explanation will not be repeated in subsequent embodiments. The descriptions below are mere examples and do not limit the scope of the appended claims. In the drawings, Y, M, C, and K are symbols appended to components corresponding to yellow, magenta, cyan, and black, respectively, and will be omitted appropriately.

The experiments conducted by inventors of the present invention have revealed that, in the case applying a superimposed bias in which a direct current voltage is superimposed over an alternating current voltage, besides a direct current voltage, as the secondary transfer bias, a plurality of white spots tend to be formed more easily in an image at locations corresponding to the recessed parts of the paper surface. These white spots can be prevented, as explained below.

FIG. 1 is a waveform chart showing an example of a waveform of a secondary transfer bias. In the figure, a horizontal axis shows a time (t) and a vertical axis shows an output voltage (V). A positive output voltage is a voltage of a returning direction which causes a toner image to move from a recording medium side to a photoconductor side. By contrast, a negative output voltage is a voltage of transferring direction which causes the toner image to move from the photoconductor side to the recording medium side. The time-averaged value of the bias voltage ($V_{ave}$) is obtained by a calculation that is an integrated value of a waveform of the voltage in one cycle divided by a time of one cycle. The center voltage value ($V_{off}$) is a center or middle value between a maximum value of the secondary transfer bias and a minimum value of the secondary transfer bias.

The secondary transfer bias is alternately outputting a first voltage and a second voltage from a power supply, and the first voltage is for transferring the toner image from the image carrier onto the recording medium in a transfer direction, and the second voltage has an opposite polarity of the first voltage. The secondary transfer bias is set to the time-averaged value of the bias voltage ($V_{ave}$) to a polarity in the transfer direction and is set in the transfer direction side with respect to the center voltage value ($V_{off}$).

Therefore, a required transfer direction voltage (Vr) and a sufficient time-averaged value ($V_{ave}$) can be achieved while the transfer direction voltage and the voltage of the opposite polarity (Vt) are kept small. In this manner, by suppressing the voltage of the opposite polarity (Vt), which causes discharging, to be small, the formation of white spots is suppressed. Moreover, by setting the time-averaged value ($V_{ave}$) in the transfer direction side, the toner image moves from the photoconductor side to the recording medium side, and sufficient image density can be achieved in both of the recessed parts and the projected parts of a recording medium surface, while formation of white spots is avoided.

However, to output the waveform of a secondary transfer bias like the waveform illustrated in FIG. 1, a complicated control (and possibly increased costs) of the output voltage may be needed, which is changing a gradient of a rise and a fall of the voltage, and which is setting a time B of the returning direction so as to be smaller than a time A of the transfer direction.

An image forming apparatus which achieves sufficient image density in both of the recessed parts and the projected parts of a recording medium surface, which avoids the formation of white spots, which includes a simple output power supply circuit for outputting a waveform that can readily generate the secondary transfer bias voltage is described below.

Embodiment

Figure 2:
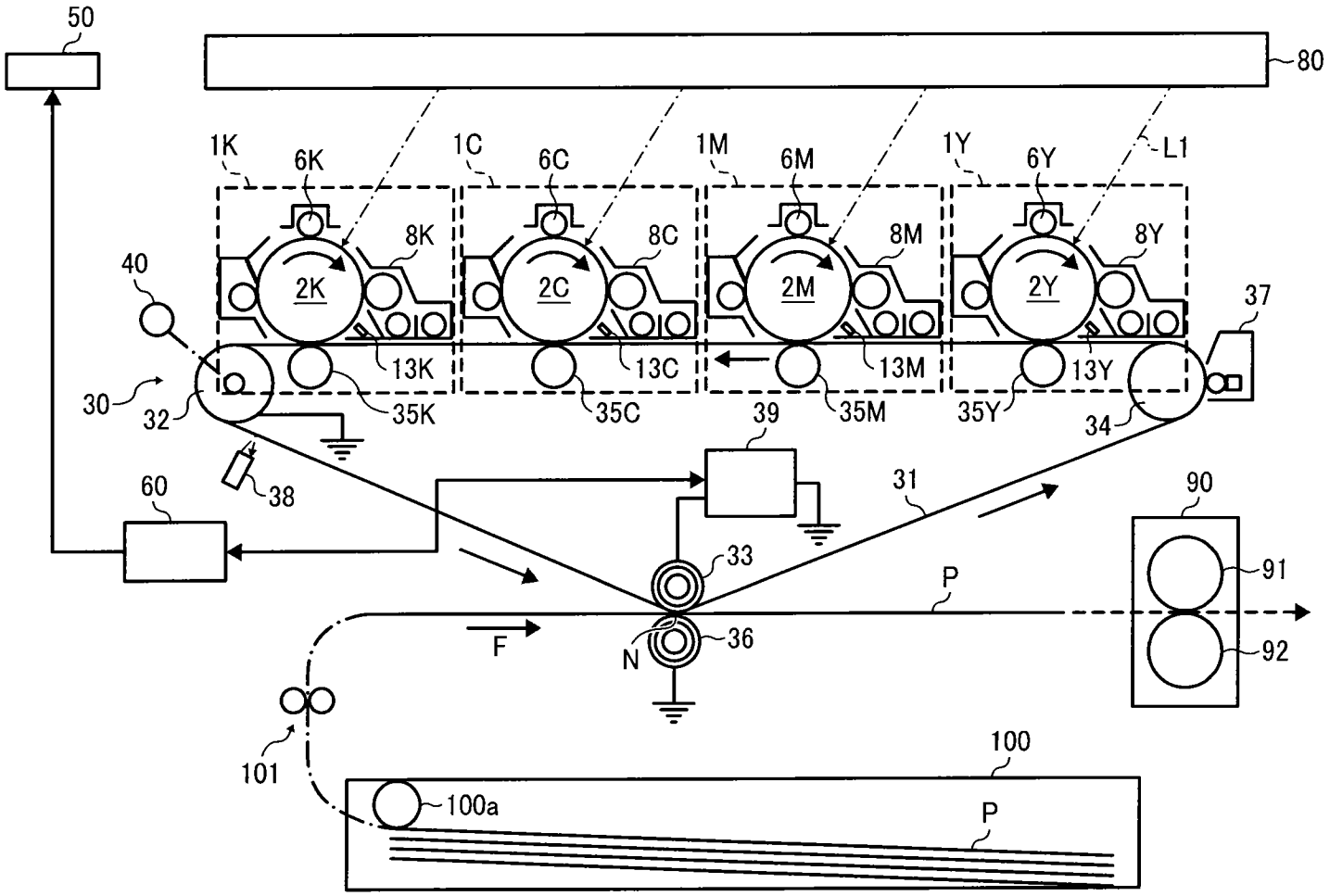
FIG. 2 is a schematic diagram illustrating a printer as an example of an image forming apparatus according to an illustrative embodiment of the present disclosure.

A description is provided of an electrophotographic color printer as an example of an image forming apparatus according to an illustrative embodiment of the present invention. FIG. 2 is a schematic for explaining a general structure of a printer according to the embodiment. In FIG. 2, the printer includes four image forming units 1Y, 1M, 1C, 1K for forming toner images in respective colors of yellow (Y), magenta (M), cyan (C), and black (K), a transfer unit 30, an optical writing unit 80, a fixing unit 90, and a paper feeding cassette 100.

Figure 3:
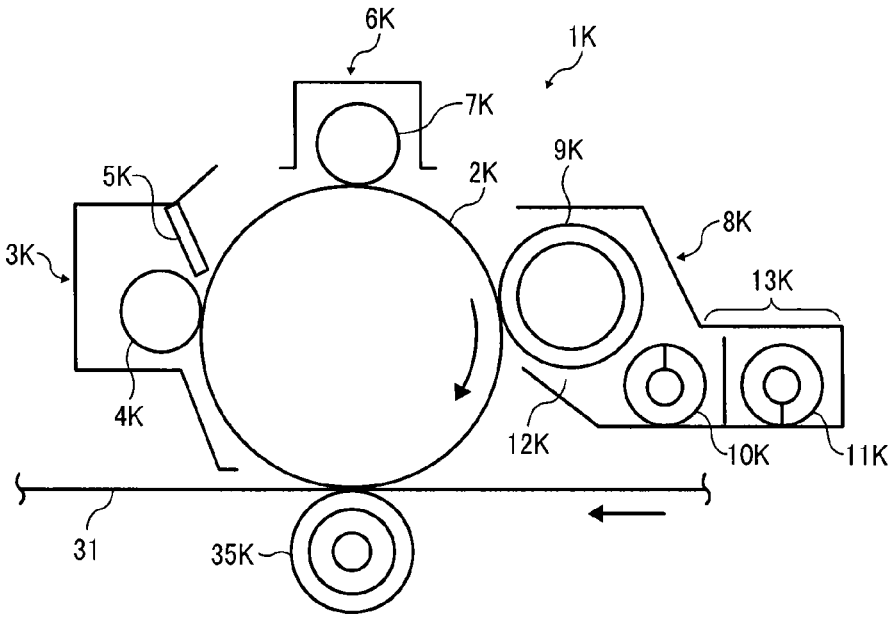
FIG. 3 is a schematic diagram illustrating an image forming unit for black as an example of image forming units employed in the image forming apparatus of FIG. 1.

FIG. 3 is a schematic diagram illustrating the image forming unit 1K. The four image forming units 1Y, 1M, 1C, and 1K have the same structures, except for Y toner, M toner, C toner, and K toner in different colors are respectively used as image forming materials, and are replaced when their lifetime ends. The image forming unit 1K for forming a K toner image is explained as an example.

As illustrated in FIG. 3, the image forming unit 1K for forming a black toner image includes a drum-shaped photoconductor 2K (hereinafter referred to as a photoconductor) serving as a latent image bearer, a drum cleaning device 3K, a charging device 6K, and a developing device 8K. These devices are held in a common casing so that they are detachably installable and replaced at the same time, if desired.

The photoconductor 2K is comprised of a drum-shaped base on which an organic photosensitive layer is disposed. The photoconductor 2K is rotated in a clockwise direction by a driving device such as a motor. The charging device 6K includes a charging roller 7K to which a charging bias is applied. The charging roller 7K contacts or approaches the photoconductor 2K to generate electrical charge therebetween, thereby charging uniformly the surface of the photoconductor 2K. According to the present illustrative embodiment, the photoconductor 2K is uniformly charged with a negative polarity which is the same polarity as the normal charge polarity of the toner. According to the present illustrative embodiment, an alternating current (AC) voltage superimposed on a direct current (DC) voltage is employed as a charging bias.

The drum cleaning device 3K removes residual toner remaining on the photoconductor 2K after a primary transfer process, that is, after the photoconductor 2K passes through a primary transfer nip between the intermediate transfer belt 31 and the photoconductor 2K. The drum cleaning device 3K includes a brush roller 4K which is rotated and a cleaning blade 5K. The cleaning blade 5K is cantilevered, that is, one end thereof is fixed to the housing of the drum cleaning device 3K and its free end contacts the surface of the photoconductor 2K. The brush roller 4K rotates and brushes off the residual toner from the surface of the photoconductor 2K while the cleaning blade 5K removes the residual toner by scraping.

It is to be noted that the cantilevered side of the cleaning blade 5K is positioned downstream from its free end contacting the photoconductor 2K in the direction of rotation of the photoconductor 2K so that the free end of the cleaning blade 5K faces or becomes counter to the direction of rotation. Further, a charge neutralizer removes residual charge remaining on the photoconductor 2K after the surface thereof is cleaned by the drum cleaning device 3K in preparation for the subsequent imaging cycle. The surface of the photoconductor 2K is initialized in preparation for the subsequent imaging cycle.

The developing device 8K includes a developing portion 12K and a developer conveyer 13K. The developing portion 12K includes a developing roller 9K therein. The developer conveyer 13K stirs black developer and transports the developer. The developer conveyer 13K includes a first chamber equipped with a first screw 10K and a second chamber equipped with a second screw 11K. Each of the first screw 10K and the second screw 11K includes a rotatable shaft and helical vane wrapped around the circumferential surface of the shaft. Each end of the shaft of the first screw 10K and the second screw 11K in the axial direction is rotatably held by shaft bearings.

The first chamber with the first screw 10K and the second chamber with the second screw 11K are separated by a partition, but each end of the wall in the axial direction of the screw shaft has a communicating opening through which the first chamber and the second chamber communicate. The first screw 10K stirs the developer by rotating the helical vane and conveys the developer from the rear side to the front side in the direction perpendicular to the paper surface in FIG. 3 while rotating. The first screw 10K is disposed parallel to and facing the developing roller 9K. The developer is delivered along the axial (shaft) direction of the developing roller 9K. The first screw 10K supplies the developer to the surface of the developing roller 9K along the direction of the shaft line of the developing roller 9K.

The developer transported near the proximal end of the first screw 10K passes through the communicating opening in the partition near the proximal side and enters the second chamber. Subsequently, the developer is carried by the helical vane of the second screw 11K. As the second screw 11K rotates, the developer is transported from the proximal end to the distal end while being stirred in the direction of rotation. Further, the developer is conveyed from the front side to the rear side in the direction perpendicular to the paper surface in FIG. 3 while rotating.

The developing roller 9K in the developing portion 12K faces the first screw 10K as well as the photoconductor 2K through an opening formed in the casing of the developing device 8K. The developing roller 9K comprises a cylindrical developing sleeve made of a non-magnetic pipe or tube which is rotated, and a magnetic roller disposed inside the developing sleeve. The magnetic roller is fixed to prevent the magnetic roller from rotating together with the developing sleeve. The developer supplied from the first screw 10K is attracted to the surface of the developing sleeve due to the magnetic force of the magnetic roller. As the developing sleeve rotates, the developer is transported to a developing area facing the photoconductor 2K.

The developing sleeve is supplied with a developing bias having the same polarity as toner. The developing bias is greater than the bias of the electrostatic latent image on the photoconductor 2K, but less than the charging potential of the uniformly charged photoconductor 2K. With this configuration, a developing potential that causes the toner on the developing sleeve to move electrostatically to the electrostatic latent image on the photoconductor 2K acts between the developing sleeve and the electrostatic latent image on the photoconductor 2K. A non-developing potential acts between the developing sleeve and the non-image formation areas of the photoconductor 2K, causing the toner on the developing sleeve to move to the sleeve surface. Due to the developing potential and the non-developing potential, the toner on the developing sleeve moves selectively to the electrostatic latent image formed on the photoconductor 2K, thereby forming a visible toner image.

In FIG. 2 described above, similar to the image forming unit 1K, in the image forming units 1Y, 1M, and 1C, toner images of yellow, magenta, and cyan are formed on the photoconductors 2Y, 2M, and 2C, respectively.

As illustrated in FIG. 2, the optical writing unit 80 for writing a latent image on the photoconductors 2Y, 2M, 2C, and 2K is disposed above the image forming units 1Y, 1M, 1C, and 1K. Based on image information provided by external devices such as a personal computer (PC), the optical writing unit 80 illuminates the photoconductors 2Y, 2M, 2C, and 2K with a light beam projected from a light source, for example, a laser diode of the optical writing unit 80. Accordingly, electrostatic latent images of yellow, magenta, cyan, and black are formed on the photoconductors 2Y, 2M, 2C, and 2K, respectively, and the potential of the portion of the charged surface of the photoconductor 2 illuminated with the light beam is attenuated.

The potential of the illuminated portion of the photoconductor 2 with the light beam is less than the potential of other areas of the photoconductor 2, that is, a background portion (non-image formation area), thereby forming an electrostatic latent image on the surface of the photoconductor 2. The optical writing unit 80 includes a polygon mirror, a plurality of optical lenses, and mirrors. The light beam projected from the laser diode serving as a light source is deflected in a main-scanning direction by the polygon mirror rotated by a motor. The deflected light, then, illuminates the optical lenses and mirrors, thereby scanning each photoconductor. Alternatively, the optical writing unit 80 may employ a light source using an LED array including a plurality of LEDs that projects light.

The transfer unit 30 is disposed below the image forming units 1Y, 1M, 1C, and 1K. The transfer unit 30 includes the intermediate transfer belt 31 formed into an endless loop and entrained about a plurality of rollers, thereby being moved endlessly in the counterclockwise direction indicated by the arrows. The transfer unit 30 also includes a drive roller 32, an opposed roller 33 (secondary transfer rear surface roller), a cleaning backup roller 34, a nip forming roller 36, a belt cleaning device 37, and four primary transfer rollers 35Y, 35M, 35C, and 35K as transfer devices.

The intermediate transfer belt 31 is entrained around and stretched taut between the drive roller 32, the opposed roller 33, the cleaning backup roller 34, and the primary transfer rollers 35Y, 35M, 35C, and 35K (which may be collectively referred to as the primary transfer rollers 35, unless otherwise specified). The drive roller 32, the opposed roller 33, the cleaning backup roller 34, and the primary transfer rollers 35Y, 35M, 35C, and 35K are disposed inside the loop formed by the intermediate transfer belt 31. According to the present illustrative embodiment, the drive roller 32 is rotated in the counterclockwise direction by a driving device 43 such as a motor, and rotation of the drive roller 32 enables the intermediate transfer belt 31 to rotate in the counterclockwise direction in FIG. 2.

The intermediate transfer belt 31 is interposed between the primary transfer rollers 35Y, 35M, 35C, and 35K, and the photoconductors 2Y, 2M, 2C, and 2K. Accordingly, primary transfer nips are formed between the front surface (image bearing surface) of the intermediate transfer belt 31 and the photoconductors 2Y, 2M, 2C, and 2K. A primary transfer bias is applied to the primary transfer rollers 35Y, 35M, 35C, and 35K by a primary transfer bias power source. Accordingly, a transfer electric field is formed between the primary transfer rollers 35Y, 35M, 35C, and 35K, and the toner images of yellow, magenta, cyan, and black formed on the photoconductors 2Y, 2M, 2C, and 2K.

Each of the primary transfer rollers 35Y, 35M, 35C, and 35K includes an elastic roller including a metal cored bar on which a conductive sponge layer is fixated. The shaft center of each of the shafts of the primary transfer rollers 35Y, 35M, 35C, and 35K is approximately 2.5 mm off from the shaft center of the shafts of the photoconductors 2Y, 2M, 2C, and 2K toward the downstream side in the traveling direction of the intermediate transfer belt 31. According to the present illustrative embodiment, a primary transfer bias under constant current control is applied to the primary transfer rollers 35Y, 35M, 35C, and 35K. According to the present illustrative embodiment, roller-type primary transfer devices, that is, the primary transfer rollers 35Y, 35M, 35C, and 35K, are employed as primary transfer devices. Alternatively, a transfer charger and a brush-type transfer device may be employed as the primary transfer device.

The opposed roller 33 includes a core metal, and a conductive nitrile butadiene rubber (NBR) based rubber layer covering the surface of the core metal. The nip forming roller 36 also includes a core metal, and a NBR-based rubber layer covering the surface of the core metal. The nip forming roller 36 in the transfer unit 30 is arranged outside of the loop of the intermediate transfer belt 31, and nips the intermediate transfer belt 31 with the opposed roller 33 arranged inside of the loop. In this manner, a secondary transfer nip N where the front surface of the intermediate transfer belt 31 and the nip forming roller 36 abut against each other is formed.

As illustrated in FIG. 2, the nip forming roller 36 is grounded. The secondary transfer bias as a voltage is applied to the opposed roller 33 from a power supply 39 for the secondary transfer bias. In this manner, a secondary transfer field is formed between the opposed roller 33 and the nip forming roller 36 so that the toner having negative polarity is electrostatically moved in a direction from the opposed roller 33 toward the nip forming roller 36.

Figure 4:
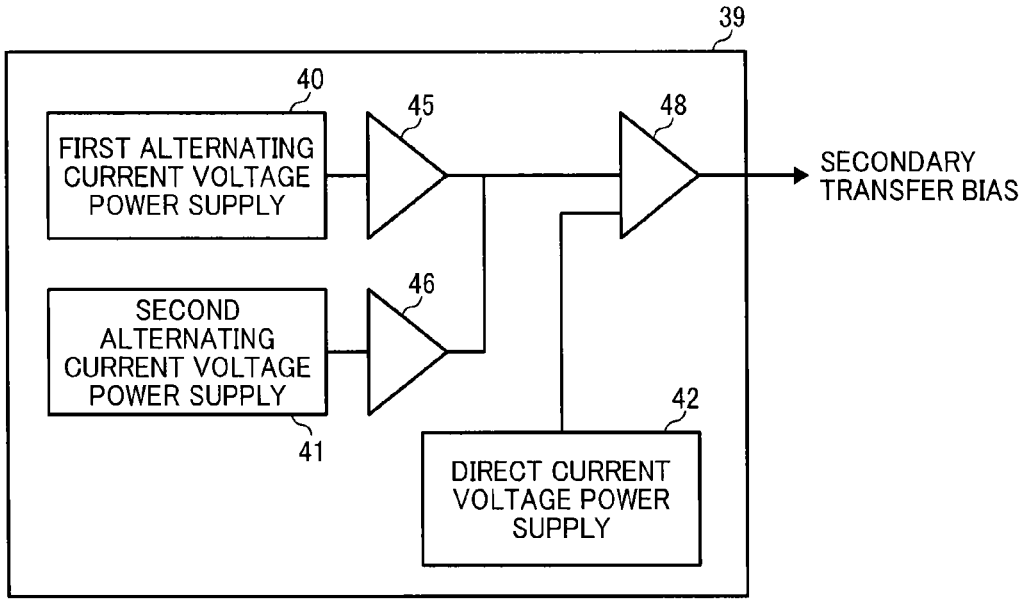
FIG. 4 is a block diagram illustrating a configuration of a power supply according to an embodiment of the present disclosure.

FIG. 4 is a block diagram illustrating a configuration of a power supply (secondary transfer power supply) in the embodiment of the present disclosure. As illustrated in FIG. 4, the power supply 39 includes a first alternating current voltage power supply 40, a second alternating current voltage power supply 41, a direct current voltage power supply 42, operational amplifiers 45 and 46, and a power amplifier 48. Two alternating current voltages outputted from the first and second alternating current voltage power supplies 40 and 41 are superimposed when passing through the operational amplifiers 45 and 46. After being superimposed, they are further superimposed on a direct current voltage of the direct current voltage power supply 42 at the power amplifier 48, and become the secondary transfer bias. Namely, the power supply 39 according to this embodiment of the present invention outputs the secondary transfer bias which includes a direct component and an alternating component which are superimposed.

Further, it is possible to change the configuration of the power supply 39 such that the power supply 39 includes three or more alternating current voltage power supplies and outputs an alternating current voltage which outputs of the alternating current voltage power supplies are superimposed.

Moreover, the inventor has determined that when the direct current component of the secondary transfer bias is in a constant current control, it become easier for a transfer current that flows into the recording medium which is thick. For this reason, the direct current component of the secondary transfer bias is in a constant current control in this embodiment of the present invention. In general, thick paper is considered to have a thickness that is greater than a thickness of normal paper. The thickness may be measured or quantified by the weight of the paper per unit area, for example, one square meter. According to an embodiment, the weight of one square meter of a normal recording medium is in a range of 60-81 g/m$^2$. Thus, when the weight of the paper is greater than 81 g/m$^2$, the paper may be considered thick. Thick paper may be categorized into five different ranges, for example. A first thickness range of the recording medium is 82-105 g/m$^2$, or 82 g/m$^2$ or greater. A second thickness range of the recording medium is 106-169 g/m$^2$, or 106 g/m$^2$ or greater. A third thickness range of the recording medium is 170-220 g/m$^2$, or 170 g/m$^2$ or greater. A fourth thickness range of the recording medium is 221~256 g/m$^2$, or 221 g/m$^2$ or greater. A fifth thickness range of the recording medium is 257-300 g/m$^2$, or 257 g/m$^2$ or greater. Returning back to FIG. 2, the explanation of the printer is continued below. The belt cleaning device 37 which contacts the surface of the intermediate transfer belt 31 removes toner residue, which has not been transferred onto the recording medium P, and which remains on the intermediate transfer belt 31. The cleaning auxiliary roller 34 disposed inside the loop formed by the intermediate transfer belt 31 supports the cleaning operation performed by the belt cleaning device 37 from inside the loop of the intermediate transfer belt 31 so that the toner residue remaining on the intermediate transfer belt 31 is reliably removed.

The paper cassette 100 storing a bundle of recording medium P is disposed substantially below the transfer unit 30. The paper cassette 100 is equipped with a feed roller 100*a* that contacts a top sheet of the bundle of recording medium P. As the feed roller 100*a* is rotated at a predetermined speed, the feed roller 100*a* picks up the top sheet and feeds it to a paper feed path in the image forming apparatus. Substantially at the end of the paper feed path, the pair of registration rollers 101 is disposed.

The fixing device 90 is disposed downstream from the secondary transfer nip N in the direction of conveyance of the recording medium P. The fixing device 90 includes a fixing roller 91 and a pressing roller 92. The fixing roller 91 includes a heat source such as a halogen lamp therein. While rotating, the pressing roller 92 pressingly contacts the fixing roller 91, thereby forming a heated area called a fixing nip therebetween.

Next, an image formation operation of the printer in this embodiment is described below. As illustrated in FIGS. 2 and 3, the first, the photoconductors 2Y, 2M, 2C, and 2K are rotated in a direction of the corresponding arrows shown in FIGS. 2 and 3 by a driving source. Each of the surfaces of the photoconductors 2Y, 2M, 2C, and 2K are discharged by the discharging devices. Consequently, each of the surfaces of the photoconductors 2Y, 2M, 2C, and 2K are uniformly charged by the charging devices 6Y, 6M, 6C, and 6K. Next, the surfaces of the photoconductors 2Y, 2M, 2C, and 2K are irradiated with the laser light from the optical writing unit 80. Then, the electrostatic latent images are formed on each of the surfaces of the photoconductors 2Y, 2M, 2C, and 2K. Consequently, the electrostatic latent images are supplied with a corresponding color of toner from the developing devices 8Y, 8M, 8C, and 8K, and then, they become a visible image as a developed toner image.

The intermediate transfer belt 31 is rotated in a direction of the corresponding arrows shown in FIGS. 2 and 3 by a driving source. The primary transfer bias, which has an opposite polarity as compared to the charging polarity of the toner image, is applied to each of the primary transfer rollers 35Y, 35M, 35C, 35K. In this manner, transfer electric fields are formed between the respective photoconductors 2Y, 2M, 2C, 2K and the intermediate transfer belt 31, and then, the toner images in Y, M, C, K that are on the respective photoconductors 2Y, 2M, 2C, 2K are primary transferred on the intermediate transfer belt 31 in an electrostatic manner.

In this manner, the intermediate transfer belt 31 on which the Y toner image is primarily transferred is then passed through the primary transfer nips for M, C, and K sequentially. The toner images in M, C, and K formed on the photoconductors 2M, 2C, 2K are sequentially superimposed over the Y toner image, to be primarily transferred. By superimposing primary transfers, a four-color superimposed toner image is formed on the intermediate transfer belt 31.

Additionally, recording medium P to have an image formed thereon is conveyed to the pair of registration rollers 101 after being picked up from the bundle stacked in the paper feeding cassette 100 by the paper feeding roller 100*a*.

The pair of registration rollers 101 stops rotating temporarily, immediately after the recording medium P delivered from the paper cassette 100 is interposed between the registration rollers 101. The pair of registration rollers 101 starts to rotate again to feed the recording medium P to the secondary transfer nip N in appropriate timing such that the recording medium P is aligned with the composite toner image formed on the intermediate transfer belt 31 in the secondary transfer nip N. In the secondary transfer nip N, the recording medium P tightly contacts the composite toner image on the intermediate transfer belt 31, and the composite toner image is transferred onto the recording medium P by the secondary transfer electric field and the nip pressure applied thereto.

The recording medium P, on which the composite color toner image is to be transferred, passes through the secondary transfer nip N where it receives the composite color image and separates from the nip forming roller 36 and the intermediate transfer belt 31 by a self-stripping. Subsequently, the recording medium P bearing an unfixed toner image on the surface thereof is delivered to the fixing device 90 and interposed between the fixing roller 91 and the pressing roller 92. The surface of the recording medium P bearing the unfixed toner image tightly contacts the fixing roller 91. Under heat and pressure, toner adhered to the toner image is softened and fixed to the recording medium P in the fixing nip. Subsequently, the recording medium P is output outside the image forming apparatus from the fixing device 90 via the delivery path after fixing.

According to the present illustrative embodiment, the controller 60 can carry out different printing modes including, but not limited to, a normal mode, a high-quality mode, and a high-speed mode. In the normal mode, a process linear velocity, that is, a linear velocity of the photoconductor and the intermediate transfer belt, is approximately 280 mm/s. It is to be noted that the process linear velocity in the high quality mode in which priority is given to image quality over the printing speed is slower than that in the normal mode. On the contrary, the process linear velocity in the high-speed mode in which priority is given to the printing speed over the image quality is faster than that in the normal mode. Users can change the print modes between the normal mode, the high-quality mode, and the high-speed mode through a control panel 50 (illustrated in FIG. 2) of the image forming apparatus or a printer property menu in a personal computer.

In a case in which a monochrome image is formed, a movable support plate supporting the primary transfer rollers 35Y, 35M, and 35C of the transfer unit 30 is moved to separate the primary transfer rollers 35Y, 35M, and 35C from the photoconductors 2Y, 2M, and 2C. Accordingly, the front surface of the intermediate transfer belt 31, that is, the image bearing surface, is separated from the photoconductors 2Y, 2M, and 2C so that the intermediate transfer belt 31 contacts only the photoconductor 2K. In this state, only the image forming unit 1K is activated to form a toner image of black on the photoconductor 2K.

A waveform of the secondary transfer bias as a feature of this invention is more particularly described below.

Figure 5:
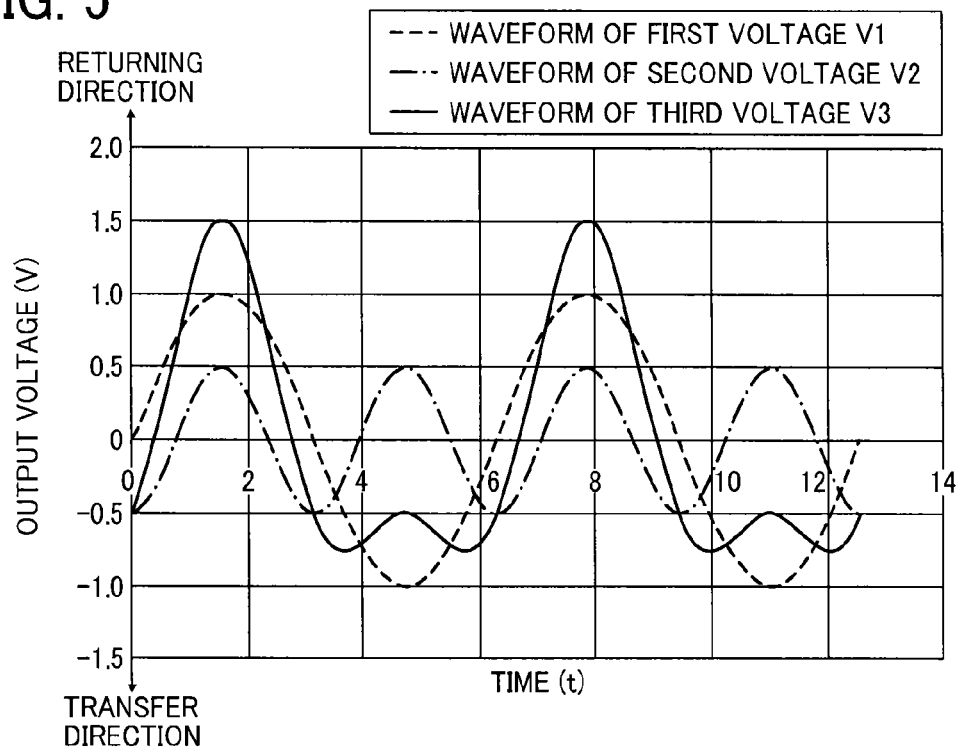
FIG. 5 is a waveform chart showing an example of a waveform of a voltage output from a power supply.

FIG. 5 is a waveform chart showing an example of a waveform of a voltage output from a power supply. In FIG. 5, the horizontal axis represents time (t) and the vertical axis represents output voltage (V). A plus side of the output voltage is a voltage in a returning direction which causes the toner image to return from the recording medium side to the image bearer (intermediate transfer belt) side. On the other hand, a minus side of the output voltage is a voltage in a transferring direction which causes the toner image to transfer from the image bearer (intermediate transfer belt) side to the recording medium side. Hereafter, for the same style of the graph, an explanation of the graph is omitted.

Each of a first waveform V1 of the voltage, a second waveform V2 of the voltage, and a third waveform V3 of the voltage is defined as formula (1), formula (2), and formula (3), below, (i.e. "t" represents a time, "$V_0$" represents an amplitude, and "ω" represents an angular frequency)

$$V1=V_0 \sin(\omega t) \quad \text{Formula (1)}$$

$$V2=0.5\times V_0 \sin(2\omega t-\pi/4) \quad \text{Formula (2)}$$

$$V3=V_0 \sin(\omega t)+0.5\times V_0 \sin(2\omega t-\pi/4) \quad \text{Formula (3)}$$

The third waveform V3 of the voltage is superimposed on the first waveform V1 of the voltage and the second waveform V2 of the voltage. As compared with the first waveform V1 of the voltage, the second waveform V2 of the voltage is 0.5 times in the amplitude, double in the angular frequency, and π/4 delayed in phase. Further, the secondary transfer bias includes the direct current component also. For a more simple explanation, the direct current component is set to 0 [V]. Hereafter, $V_0$ is set to 1, ω is set to 1.

Next, an explanation is provided to normalize the third waveform V3 of the voltage. The meaning of "to normalize a function F (t)" is to calculate formula (4) below.

$$f(t)=\frac{F(t)-\frac{\mathrm{Max}(F(t))+\mathrm{Min}(F(t))}{2}}{\frac{\mathrm{Max}(F(t))-\mathrm{Min}(F(t))}{2}} \quad \text{Formula (4)}$$

In this formula (4), Max( ) is a function which calculates a maximum value and Min( ) is a function which calculates a minimum value.

From formula (4), the meaning of "to normalize a function F (t)" is to convert the function F (t) to a function f (t) whose center value is 0 and whose amplitude is 1.

Figure 6:
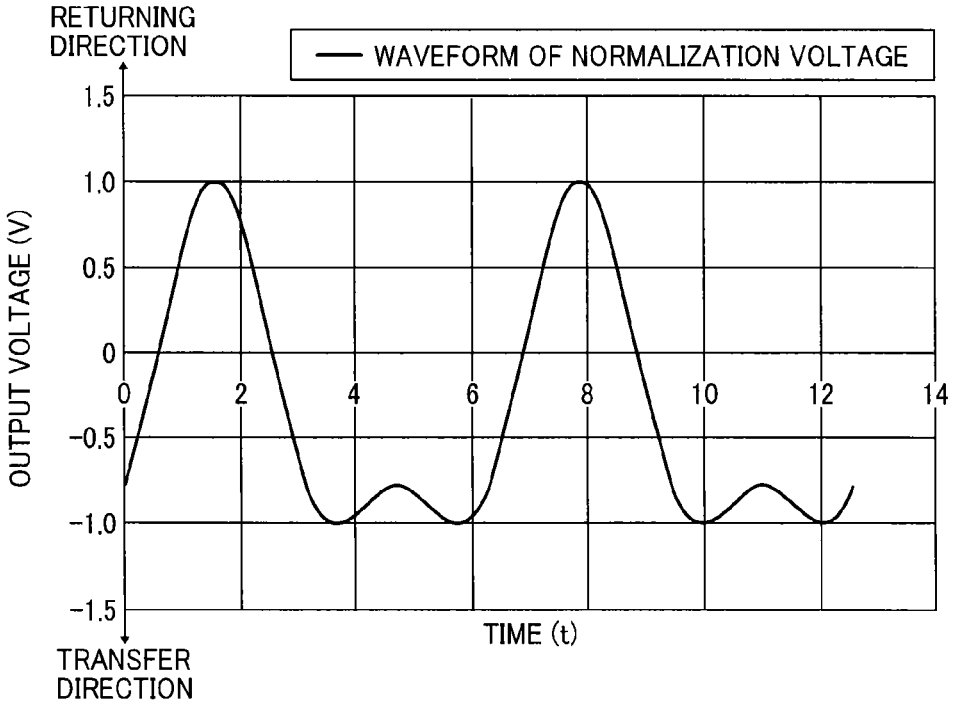
FIG. 6 is a waveform chart showing a waveform obtained from a normalization of a waveform of a third voltage.

FIG. 6 is a waveform chart showing a waveform obtained from a normalization of a waveform of a third voltage. This waveform is denominated a waveform $V_{norm}$ of the voltage. Clearly from the graph, the normalized waveform has a vertically unsymmetrical shape relative to a line of V=0. To define an integral value of one cycle of the normalized waveform $V_{norm}$ as an integrated value of normalization voltage ($V_{norm_int}$ the integrated value of normalization voltage ($V_{norm_int}$) is −0.33 [Vs]. Namely, in one cycle of the third waveform V3 of the voltage, a time average value of the output voltage is larger in the transferring direction than in the returning direction. Like this, the waveform of the voltage is described in the description as "biased" when the integrated value of normalization voltage ($V_{norm_int}$) is not 0. Then, the third waveform V3 of the voltage is biased because the integrated value of normalization voltage ($V_{norm_int}$) is on the transferring direction side.

From this, the third waveform V3 of the voltage includes two features explained below. First, the voltage of the transferring direction and the voltage of the opposite direction to the transferring direction (returning direction) are alternatively changed with each other. Second, the third waveform V3 of the voltage is biased on the transferring direction side. This configuration has a same meaning as the time average value of the voltage ($V_{ave}$) is set in the polarity of the transferring direction, and as the time average value of the voltage ($V_{ave}$) is set in the transferring direction side relative to the center voltage value ($V_{off}$). Accordingly, to set such the third waveform V3 of the voltage as the secondary transfer bias, it is possible to achieve sufficient image density in both of the recessed parts and the projected parts of a recording medium surface and to avoid the formation of white spots.

Each of the first waveform V1 of the voltage and the second waveform V2 of the voltage is defined as formula (1) and (2), but not limited. As compared with the first waveform V1 of the voltage, the amplitude, the angular frequency, and the phase delay of the second waveform V2 of the voltage are possible to set in a range described below.

Figure 7:
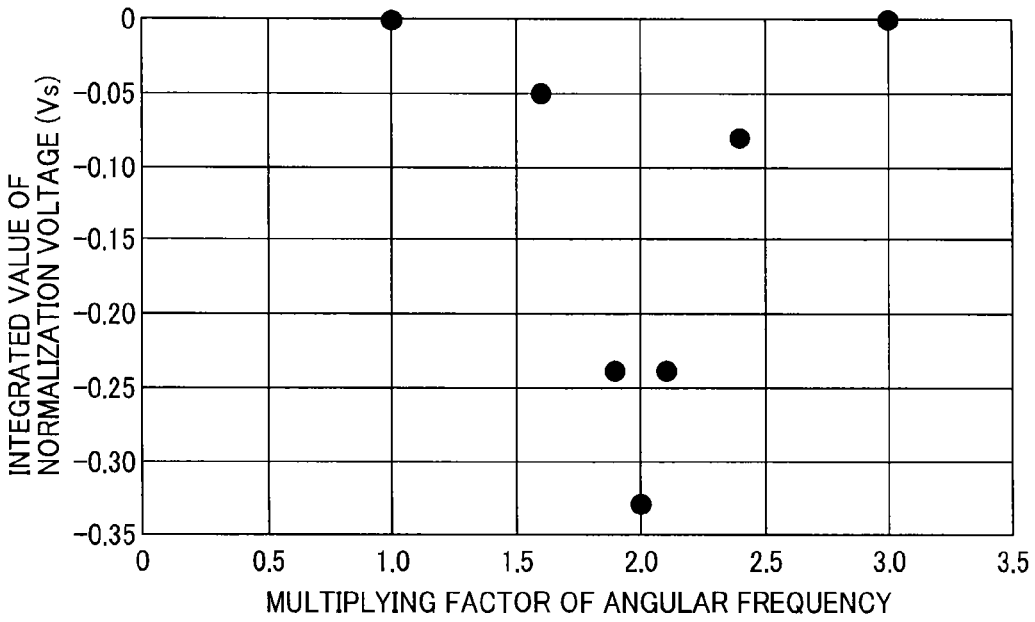
FIG. 7 is a graph illustrating a relationship between a multiplying factor of an angular frequency and an integrated value of normalization voltage.

FIG. 7 is a graph illustrating a relationship between a multiplying factor of an angular frequency and an integrated value of normalization voltage. In FIG. 7, the horizontal axis represents a multiplying factor of angular frequency of the second waveform V2 of the voltage with respect to the first waveform V1 of the voltage. The vertical axis represents the integrated value of normalization voltage ($V_{norm_int}$). From the graph of FIG. 7, when the multiplying factor of angular frequency is around the range of 1.9~2.1 times, the integrated value of normalization voltage ($V_{norm_int}$) becomes expressly small. This means that a biased degree of the integrated value of normalization voltage ($V_{norm_int}$) toward the transferring direction side becomes larger.

Figure 8:
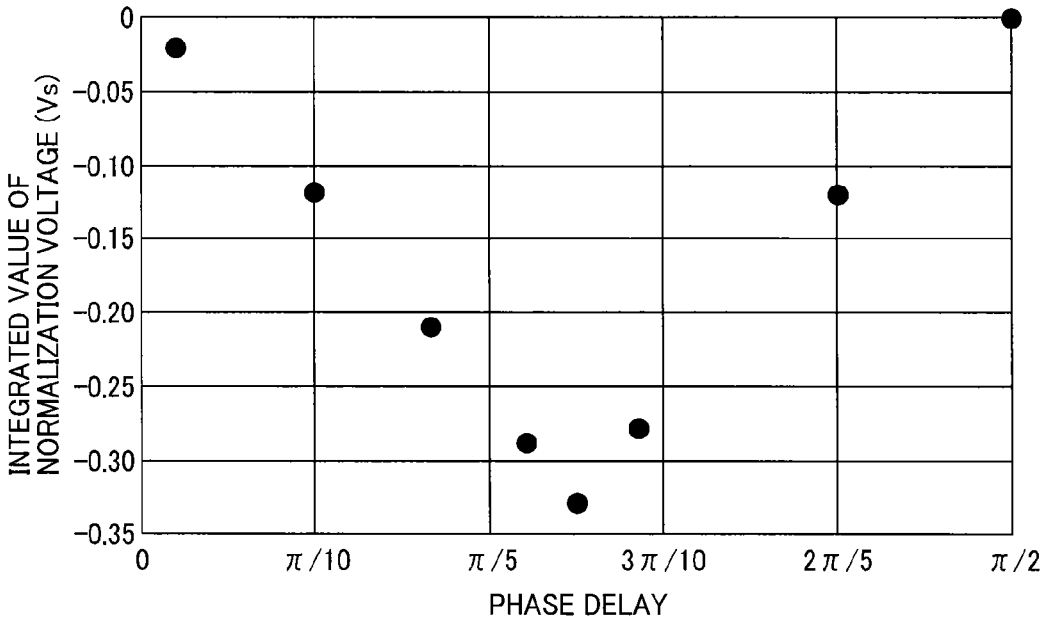
FIG. 8 is a graph illustrating a relationship between a phase delay and an integrated value of normalization voltage.

FIG. 8 is a graph illustrating a relationship between a phase delay and an integrated value of normalization voltage. In FIG. 8, the horizontal axis represents a phase delay of the second waveform V2 of the voltage. The vertical axis represents the integrated value of normalization voltage ($V_{norm_int}$). From the graph of FIG. 8, when the phase delay is around the range of 0.22π~0.29π, the integrated value of normalization voltage $V_{norm_int}$ becomes small. This means that the biased degree of the integrated value of normalization voltage ($V_{norm_int}$) toward the transferring direction side becomes larger.

The angular frequency and the phase delay are parameters which define a time axis of the third waveform V3 of the voltage. For this reason, it is better that the multiplying factor of the angular frequency is around the range of 1.9~2.1 times and the phase delay is around the range of 0.22π~0.29π.

Figure 9:
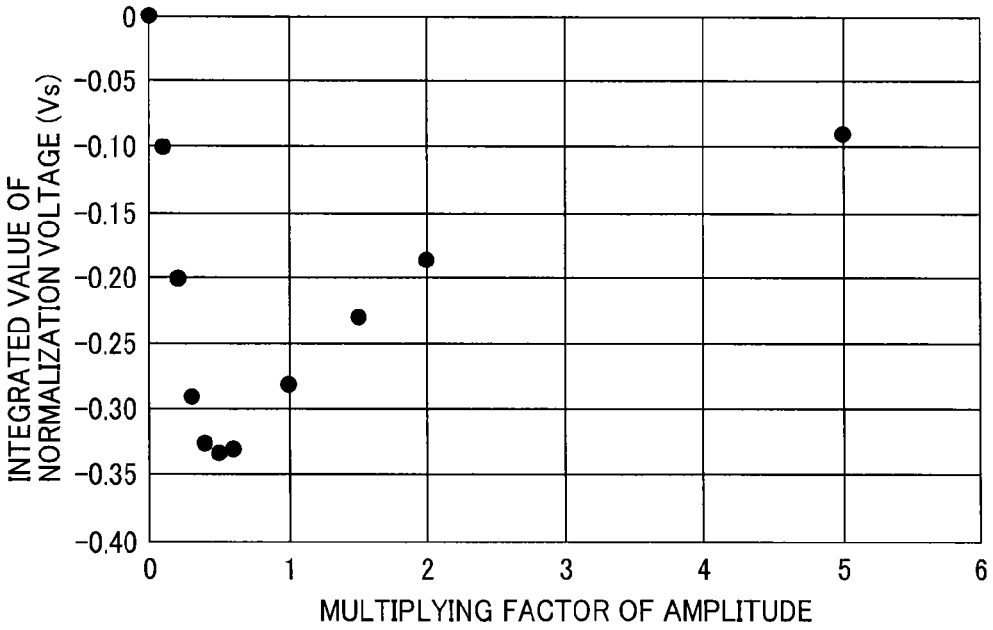
FIG. 9 is a graph illustrating a relationship between a multiplying factor of an amplitude and an integrated value of normalization voltage.

FIG. 9 is a graph illustrating a relationship between a multiplying factor of an amplitude and an integrated value of a normalization voltage. In FIG. 9, the horizontal axis represents a multiplying factor of the amplitude of the second waveform V2 of the voltage with respect to the first waveform V1 of the voltage. The vertical axis represents the integrated value of normalization voltage ($V_{norm_int}$). Understanding from the graph of FIG. 9, when the multiplying factor of the amplitude is around the range of 0.3~1.0 times, the integrated value of normalization voltage ($V_{norm_int}$) becomes small. This means that the biased degree of the integrated value of normalization voltage ($V_{norm_int}$) toward the transferring direction side becomes larger.

The amplitude is a parameter which defines an output voltage of the third waveform V3 of the voltage. For this reason, it is preferred that the multiplying factor of the amplitude is in the range of 0.3~1.0 times.

In the above description, a sine waveform of the voltage is explained as the waveform of the voltage. Further, even if the waveform of the voltage is a triangular waveform or a rectangular waveform of the voltage, it is possible to generate a waveform biased on the transferring direction side by superimposing the waveforms thereof. They are described below.

(Triangular Wave)

Figure 10:
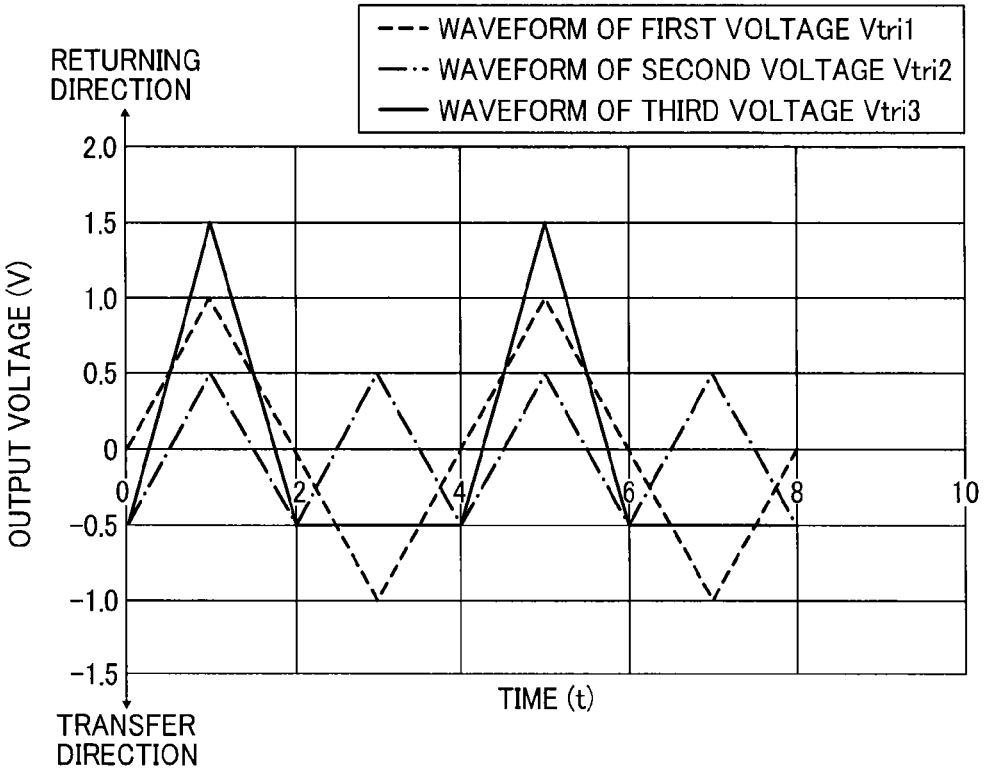
FIG. 10 is a waveform chart showing a waveform of a voltage of a triangular wave.

FIG. 10 is a waveform chart showing a waveform of a voltage of a triangular wave. As compared with the first waveform $V_{tri}$1 of the voltage, the second waveform $V_{tri}$2 of the voltage is 0.5 times the amplitude, double the angular frequency, and π/4 delay in phase. The third waveform $V_{tri}$3 of the voltage is superimposed on the first waveform $V_{tri}$1 of the voltage and the second waveform $V_{tri}$2 of the voltage. The third waveform $V_{tri}$3 of the voltage is biased on the returning direction side because the integrated value of normalization voltage ($V_{norm_int}$) of the third waveform $V_{tri}$3 of the voltage is positive.

(Rectangular Wave)

Generally, a wave which regularly changes in two levels between high and low is denominated a rectangular wave. In this embodiment, a wave which regularly changes in three levels between high and middle and low is denominated a rectangular wave including intervals.

Figure 11:
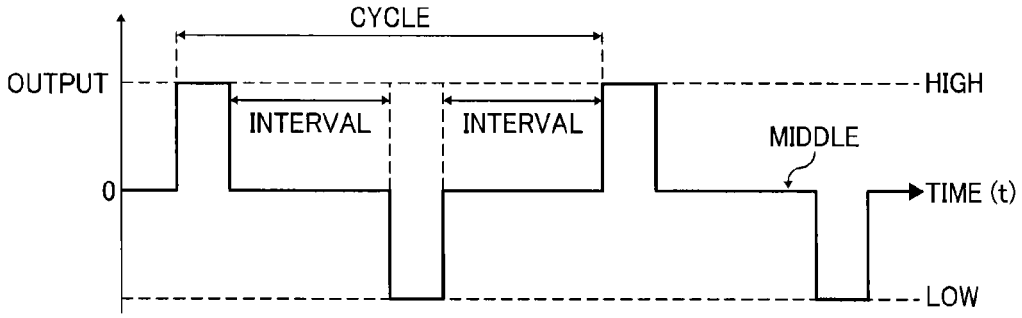
FIG. 11 is a waveform chart showing a rectangular wave including intervals.

FIG. 11 is a waveform chart showing a rectangular wave including intervals. The waveform regularly changes in three levels between high, middle and low. The cycle of the waveform is a time between a point of a rising phase for which the output becomes a high level and the next point of the rising phase. Hereafter, a time period, while the output is middle, is denominated an interval.

Figure 12:
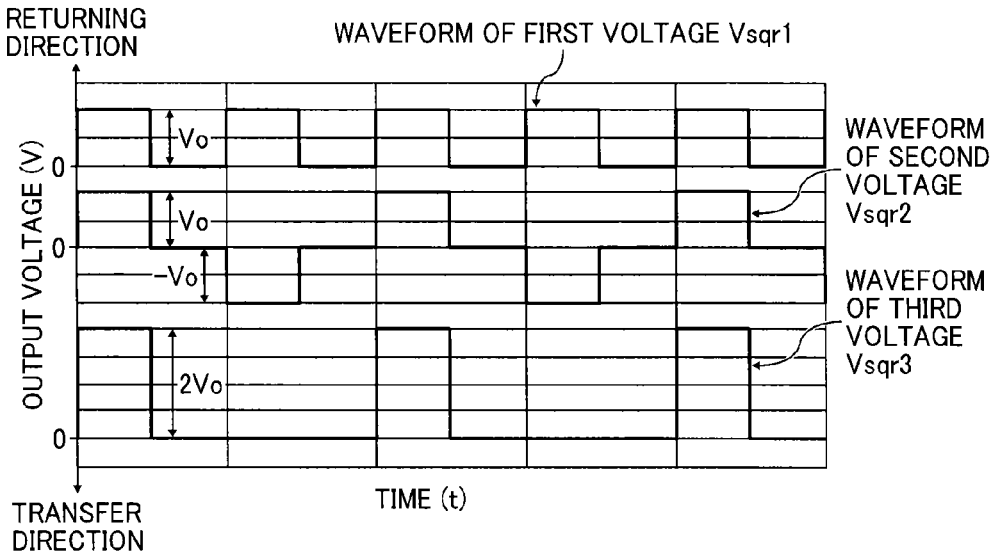
FIG. 12 is a waveform chart showing a waveform of a voltage of the rectangular wave.

FIG. 12 is a waveform chart showing a waveform of a voltage of the rectangular wave. The amplitude of the first waveform $V_{sqr}$1 of the voltage is $V_0$. The amplitude of the second waveform $V_{sqr}$2 of the voltage is $V_0$ or $-V_0$. As compared with the first waveform $V_{sqr}$1 of the voltage, the second waveform $V_{sqr}$2 of the voltage is double in the cycle. Further, the second waveform $V_{sqr}$2 of the voltage includes intervals of which the output is 0.

The third waveform $V_{sqr}$3 of the voltage is superimposed on the first waveform $V_{sqr}$1 of the voltage and the second waveform $V_{sqr}$2 of the voltage. The third waveform $V_{sqr}$3 of the voltage is biased on the returning direction side because the integrated value of normalization voltage ($V_{norm_int}$) of the third waveform $V_{sqr}$3 of the voltage is positive.

Figure 13:
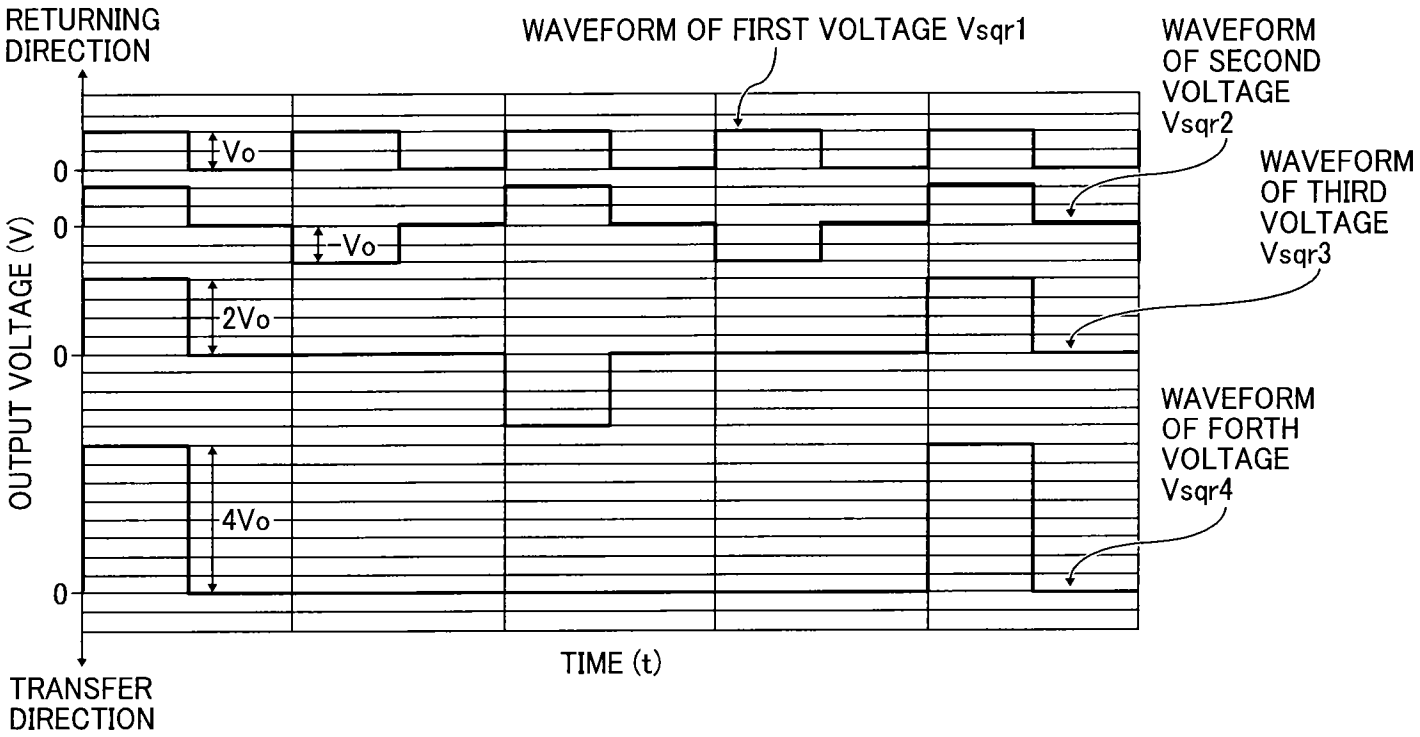
FIG. 13 is a waveform chart showing a waveform of a voltage of the rectangular wave according to another example.

FIG. 13 is a waveform chart showing a waveform of a voltage of the rectangular wave according to another example. The amplitude of the first waveform $V_{sqr}$1 of the voltage is $V_0$. The amplitude of the second waveform $V_{sqr}$2 of the voltage is $V_0$ or $-V_0$. As compared with the first waveform $V_{sqr}$1 of the voltage, the second waveform $V_{sqr}$2 of the voltage is double in the cycle. Further, the amplitude of the third waveform $V_{sqr}$3 of the voltage is $2V_0$. As compared with the first waveform $V_{sqr}$1 of the voltage, the third waveform $V_{sqr}$3 of the voltage is 4 times in the cycle. Further, the second waveform $V_{sqr}$2 of the voltage and the third waveform $V_{sqr}$3 of the voltage include intervals of which the output is 0.

The fourth waveform $V_{sqr}$4 of the voltage is superimposed on the first waveform $V_{sqr}$1 of the voltage and the second waveform $V_{sqr}$2 of the voltage and the third waveform $V_{sqr}$3 of the voltage. The forth waveform $V_{sqr}$4 of the voltage is biased on the returning direction side because the integrated value of normalization voltage ($V_{norm_int}$) of the forth waveform $V_{sqr}$4 of the voltage is positive.

The waveform of the voltage used in this embodiment is not limited to the sine waveform, the triangular waveform, and the rectangular waveform. It is possible to use an alternative waveform which occurs by being biased by superimposing the waveforms. Including that waveform, the sine waveform, the triangular waveform, and the rectangular waveform are denominated basic waveforms.

Further, in this embodiment, a minus side of the output voltage is the voltage in the transferring direction. However, depending on the polarity of the toner, it is possible to change such that the plus side of the output voltage is the voltage in the transferring direction. Further, it is possible to change the configuration such that the opposed roller 33 is grounded and the secondary transfer bias is applied to the nip forming roller 36.

In the description above, because the image forming apparatus in this embodiment is configured to output the secondary transfer bias that is biased on the transferring direction by superimposed a plurality of the alternating current voltage having basic waveform, it is possible to achieve sufficient image density in both of the recessed parts and the projected parts of a recording medium surface and to avoid the formation of white spots.

Further, because of the alternating current voltage having a basic waveform is generated by a power supply with a simple configuration, if desired, the configuration of the secondary transfer power supply in this embodiment is simple and low cost.

To advance the image density quality, the inventor examined a relationship between a process linear velocity V and a direct current outputted in a constant current control. The process linear velocity V is a linear velocity of the photoconductor or a linear velocity of the intermediate transfer belt. That means that an electric discharge image or density lack occurs when the output of the direct current does not increase and decrease depending on the process linear velocity. An evaluation result of the image quality relative to the process velocity and the direct current are described in Table 1.

TABLE 1

| | direct current [μA] | | | image quality | | |
|---|---|---|---|---|---|---|
| linear velocity | C.E. 1 | C.E. 2 | Emb. | C.E. 1 | C.E. 2 | Emb. |
| 352.8 [mm/s] | 80 | 40 | 80 | Good | D.L. | Good |
| 287.1 [mm/s] | 80 | 40 | 65 | E.D. | D.L. | Good |
| 176.4 [mm/s] | 80 | 40 | 40 | E.D. | Good | Good |

In the table 1, "linear velocity" represents a process linear velocity, "C.E.1" represents a comparative example 1, "C.E.2" represents a comparative example 2, "Emb." represents an embodiment of this invention, "D.L." represents a density lack, and "E.D." represents an electric discharge image.

Understanding from table 1, in the comparative example 1, when the process linear velocity becomes slower, the electric discharge image occurs because of excessive current. On the other hand, in the comparative example 2, when the process linear velocity becomes faster, a reduced density occurs because of a reduced current. For these reasons, in the embodiment of the present invention, when the process linear velocity becomes faster, the output of the direct current is controlled to be increased. Further, when the process linear velocity becomes slower, the output of the direct current is controlled to be decreased. By controlling the output of the direct current depending on the process linear velocity, it is possible to achieve a better image quality.

Accordingly, the printer of this embodiment is configured to acquire an inputted mode that is inputted from the control panel 50 serving as information acquiring device, and that is changed between the normal mode, the high-quality mode (low-speed mode), and the high-speed mode. The printer of this embodiment is configured to change the process linear velocity depending on the inputted mode by the controller 60 serving as a changing device. Namely, the control panel 50 is used for acquiring information of a printing speed. The controller 60 is configured to change a target value of a predetermined direct current component of the output current depending on the acquired result from the control panel 50. In this way, the printer of this embodiment is capable of outputting a better image quality because it is configured to output the direct current depending on the process velocity. Further, the printer is capable of using a communication device, which acquires a setting information of a printer driver from an outer peripherals, with the control panel 50.

The present invention may be implemented using circuitry and/or one or more processors configured and/or programmed according to the teachings of the present disclosure.

Obviously, numerous modifications and variations of the present invention are possible in light of the above teachings. It is therefore to be understood that within the scope of the appended claims, the invention may be practiced otherwise than as specifically described herein.

What is claimed is:

1. An image forming apparatus, comprising:

an image bearer to bear a toner image on a surface thereof;

a transfer device to contact the image bearer to form a transfer nip; and a power source to output a voltage to transfer the toner image from the image bearer onto a recording medium interposed in the transfer nip, the voltage including a first voltage in a transfer direction in which the toner image is transferred from the image bearer to the recording medium and a second voltage having a polarity opposite to that of the first voltage, and the first voltage and the second voltage alternating upon transfer of the toner image from the image bearer to the recording medium;

wherein the power source is configured to output the voltage that comprises a plurality of alternating current voltages having a waveform of at least one of the following: sine, triangular, and rectangular, wherein a waveform of the voltage is biased in the transferring direction, wherein the plurality of the alternating current voltages includes one voltage and another voltage, wherein a multiplying factor of an angular frequency of said another voltage compared with said one voltage is in the range of 1.9 to 2.1 times, and wherein a phase delay of said another voltage compared with said one voltage is in the range of 0.22π to 0.29π.

2. The image forming apparatus according to claim 1, wherein a multiplying factor of an amplitude of said another voltage compared with said one voltage is in the range of 0.3 to 1.0 times.

3. The image forming apparatus according to claim 1, wherein the waveform of the alternating current voltages is a sine wave.

4. The image forming apparatus according to claim 1, wherein the waveform of the alternating current voltages is a triangular wave.

5. The image forming apparatus according to claim 1, wherein the waveform of the alternating current voltages is a rectangular wave.

6. The image forming apparatus according to claim 5, wherein the rectangular wave includes intervals.

7. The image forming apparatus according to claim 1, wherein the power source is configured to output the voltage which comprises a direct current component and an alternating current component, the direct current component is in a constant current control.

8. The image forming apparatus according to claim 7, further comprising:

a user interface to acquire information of a printing speed; and a changing device configured to change a preset target for an output current of the direct current component based on the information acquired by the user interface.

9. A method of transferring an image, comprising:

forming a toner image on an image bearer;

transporting a recording medium towards the image bearer; and transferring the toner image on the image bearer to the recording medium using a voltage including a first voltage in a transfer direction in which the toner image is transferred from the image bearer to the recording medium and a second voltage having a polarity opposite to that of the first voltage, the first voltage and the second voltage alternating upon transfer of the toner image from the image bearer to the recording medium, wherein the first voltage and the second voltage are alternating current voltages having a waveform of at least one of the following: sine, triangular, and rectangular, and wherein a waveform of the voltage is biased in the transferring direction, the plurality of the alternating current voltages includes one voltage and another voltage, a multiplying factor of an angular frequency of said another voltage compared with said one voltage is in the range of 1.9 to 2.1 times, and wherein a phase delay of said another voltage compared with said one voltage is in the range of $0.22\pi$ to $0.29\pi$.

10. The method according to claim 9, wherein:

a multiplying factor of an amplitude of said another voltage compared with said one voltage is in the range of 0.3 to 1.0 times.

11. The method according to claim 9, wherein the waveform of the alternating current voltages is a sine wave.

12. The method according to claim 9, wherein the waveform of the alternating current voltages is a triangular wave.

13. The method according to claim 9, wherein the waveform of the alternating current voltages is a rectangular wave.

14. The method according to claim 13, wherein the rectangular wave includes intervals.

15. The method according to claim 9, wherein:

the voltage comprises a direct current component and an alternating current component, and the direct current component is in a constant current control.

16. The method according to claim 15, further comprising:

acquiring information of a printing speed through a user interface; and changing a preset target for an output current of the direct current component based on the information acquired by the user interface.

* * * * *